United States Patent [19]

Giberson

[11] 4,185,685

[45] Jan. 29, 1980

[54] WASTE HEAT RECOVERY SYSTEM AND METHOD

[76] Inventor: Elwood C. Giberson, 4110 Greenwood Dr., Des Moines, Iowa 50312

[21] Appl. No.: 866,452

[22] Filed: Jan. 3, 1978

[51] Int. Cl.[2] ..... F28D 15/00

[52] U.S. Cl. ..... 165/1; 165/DIG. 12; 110/162; 122/20 B; 165/39

[58] Field of Search ..... 165/1, DIG. 12, DIG. 2, 165/39; 237/55; 122/20 B; 110/162, 163

[56] References Cited

U.S. PATENT DOCUMENTS

| | | | |
|---|---|---|---|
| 1,500,838 | 7/1924 | Miller | 237/55 X |
| 2,199,183 | 4/1940 | Lippincott et al. | 122/20 B X |
| 3,710,738 | 1/1973 | Franklin | 110/163 X |
| 3,844,233 | 10/1974 | Fishback | 122/20 B X |
| 3,934,798 | 1/1976 | Goldsmith | 237/55 |
| 4,012,191 | 3/1977 | Lisankie et al. | 237/55 X |
| 4,083,398 | 4/1978 | Fallon et al. | 165/DIG. 2 X |

*Primary Examiner*—Samuel Scott
*Assistant Examiner*—Margaret A. Focarino
*Attorney, Agent, or Firm*—Rudolph L. Lowell; G. Brian Pingel

[57] ABSTRACT

A waste heat recovery system and method for recovering heat from exhaust gases flowing through an exhaust stack or flue from a source of heat. The recovery system includes a heat exchanger located within a bypass assembly that includes a pair of conduits connected to the exhaust stack, and a blower for producing a flow of exhaust gases from the exhaust stack through one of the conduits and the heat exchanger and then back to the exhaust stack through the other of the conduits. The method of the present invention includes the moving of at least a portion of the exhaust gases in the exhaust stack through the bypass assembly and returning such portion back to the exhaust stack.

6 Claims, 1 Drawing Figure

WASTE HEAT RECOVERY SYSTEM AND METHOD

SUMMARY OF THE INVENTION

The present invention provides a system and a method for recovering waste heat from exhaust gases flowing through an exhaust stack from a source of heat. The system of the present invention is formed of a heat exchanger means disposed in a bypass conduit means that includes a first conduit means connecting the inlet of the heat exchanger means to the exhaust stack and a second conduit means connecting the outlet of the heat exchanger means to the exhaust stack, and exhaust gas moving means associated with at least one of the conduit means. In the method of the present invention, at least a portion of the exhaust gases in the stack may be moved through the bypass conduit means to flow through the exchanger means and back to the stack.

In a preferred embodiment, the system of the present invention is employed with the exhaust stack of a boiler having a first blower that provides combustion air to the boiler. Exhaust gases in the boiler as a result of combustion flow into the exhaust stack, and the means for moving exhaust gases from the exhaust stack through the exchanger means is a second exhaust blower located in one of the conduit means. The volume of the exhaust gases moved by the second blower may be equal to, greater than, or less than the volume of exhaust gases flowing into the exhaust stack due to boiler combustion. However, if such volume is greater, a portion of the exhaust gases flowing from the exchanger means will be returned through the stack back to the exchanger means to satisfy the capacity of the second blower. Thus, a closed circuit flow path is provided for portions of the exhaust gases. Without this closed circuit flow, cold air from the outside would be drawn down the stack to the exchanger means whenever the volume of gases moved by the second blower exceeded that delivered to the stack from the boiler. The present invention, although relatively uncomplex in structure, substantially eliminates air being drawn from the outside through the exchanger means.

DESCRIPTION OF THE PREFERRED EMBODIMENT

Figure 1:
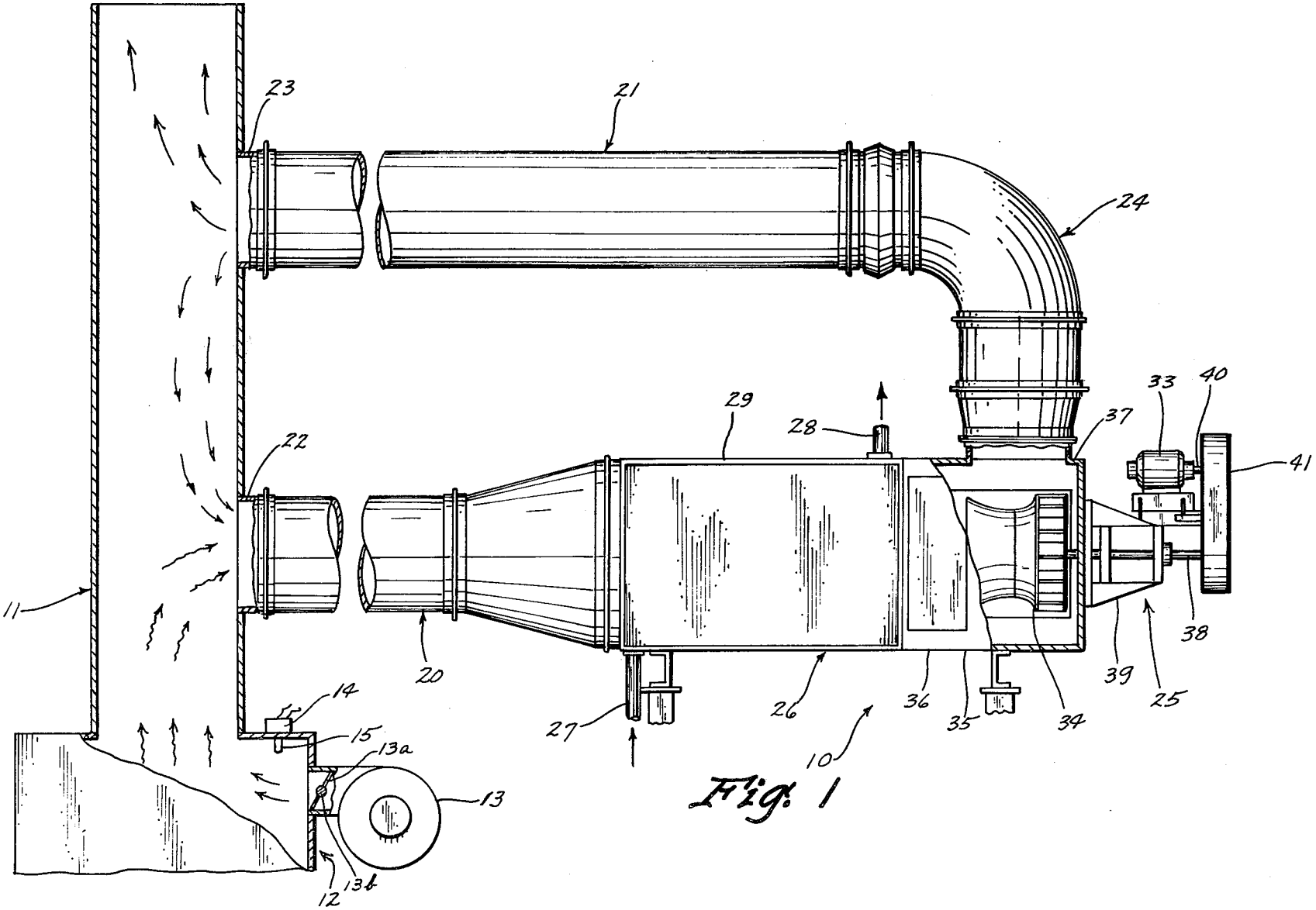
FIG. 1 is a side view of a recovery system of the present invention associated with an exhaust stack of a boiler and with portions cut away or shown in section to more clearly show the construction thereof.

A preferred embodiment of the waste heat recovery system of the present invention, indicated generally at 10 in FIG. 1, is adapted to recover heat from exhaust gases flowing through an exhaust stack 11 from a source of heat such as a boiler 12 or the like. The system 10 is preferably employed in installations wherein it is desirable to avoid introducing a resistance to gas flow in the exhaust stack in order that the air-fuel combustion settings of the heat source is not disturbed.

The boiler 12 includes an air blower 13 that may run continously to provide combustion air to the boiler 12. However, a blower damper **13*a* is mounted on an axle 13*b* at the outlet of the blower 13 and is position controlled by a temperature or pressure controller 14 having a temperature or pressure sensor 15 in the boiler 12. Consequently, in response to sensing signals from the sensor 15 the damper 13*a* respectively increases or decreases the volume of air delivered by the blower 13 whenever the temperature or pressure falls below, or rises above a set point. As a result of combustion in the boiler 12, exhaust gases from the boiler are forced into the exhaust stack 11 at a maximum rate solely limited by the amount of air flow into the boiler from the blower 13**.

The system 10 serves as an auxiliary or bypass path of flow for the exhaust gases from the boiler 12 and is best adapted to operate efficiently on new or existing single boiler installations of 1000 boiler horse power or less. As shown, the system 10 is comprised of a pair of conduits 20 and 21 having one of their ends 22 and 23, respectively, open at vertically spaced positions to the stack 11 and connected at their opposite ends by an elbow shaped conduit 24 to form a bypass for the stack gases. As the exhaust gases from the boiler 12 rise in the stack 11 they are drawn by a blower 25 into the end 22 of the lower or first conduit 20, through a heat exchanger 26 in the conduit 20, and through the elbow 24 and upper or second conduit 21 for return to the stack 11 at the end 23 of the conduit 21.

The heat exchanger 26 is of standard construction and is designed to serve as a means for transferring heat from the exhaust products to a liquid that is supplied to the exchanger 26 via an inlet line 27 for heating of the liquid and is removed from the exchanger 26 via an outlet line 28, after being heated. A housing 29 for the exchanger 26 forms part of the conduit 20. Incoming water or liquid from the line 27 may be fed into a usual heat exchanger coil arrangement (not shown) or other such heat transfer means forming part of the exchanger 26 and disposed in the housing 29 for circulation therethrough to the outlet line 28. The heated liquid from the exchanger 26 may then be fed into the boiler 12, or employed for various other uses.

For a most preferred operation the blower 25 is located on the downstream side of the heat exchanger 26 to limit the temperature of the exhaust gases imposed on the blower 25. However, in some applications it may be advantageous, because of space or mechanical limitations, to mount the blower 25 on the upstream side of the exchanger 26.

The blower 25 includes an electric motor 33 for driving an impeller or rotor 34 disposed in a housing 35, which also forms a part of the conduit 20, and communicates with the heat exchanger housing 29 at one end 36 and at its other end 37 with the elbow 24. The impeller 34 is mounted on an output shaft 38 of a bearing support unit 39, and the motor 33 is connected to a motor output shaft 40 via a "V" belt drive assembly 41.

On and off actuation of the blower 25 is preferably controlled in correspondence to the position of the damper **13*a* in the outlet of the blower 13 by means such as a cam-microswitch assembly (not shown) associated with the damper axle 13*b*. When the damper 13*a* is opened beyond a preselected minimum open position setting, the blower 25 is actuated to an "on" condition to thereby begin drawing exhaust gases through the system 10. Thus, the blower 25 is independently actuated so that exhaust gases are drawn through the exchanger 26 by the blower 25 only when such gases are in sufficient mass and at such temperature to make use of the system 10** economically feasible.

When the combustion in the boiler 12 is such that the volume of exhaust gases forced from the boiler into the stack 11 is less than the volume of gases passing through the blower 25, a portion of the exhaust gases exiting from the conduit 21 will be drawn downward to recirculate back into the conduit 20 and through the heat exchanger 26 to maintain the rated capacity of the blower 25.

Since the weight of the exhaust gases finally discharged to the atmosphere remains unchanged, any change in the resistance to gas flow in the primary combustion system is substantially eliminated with a resultant minimum disturbance of the primary combustion settings. Also, since the gases induced through the heat exchanger are both drawn from and returned to the same stack, the heat recovery system can be operated, without the employment of stack gas controls or damper controls, with a total volume or weight of the gases equal to, greater than, or less than the volume or weight of the gases moving through the exchanger without diluting the exhaust gases with cold atmosphere gases and with minimum interference of the air or fuel settings of the primary combustion system.

Although the invention has been described with respect to recovering the heat from gases produced from a single source of heat, the invention is also suited to recover heat from hot exhaust gases produced from several sources of heat that feed a single exhaust stack. Furthermore, the system 10 is not limited to application in which a vertical exhaust stack is employed but may as well be used in connection with horizontally aligned stacks.

Although the invention has been described with respect to a preferred embodiment thereof, it is to be understood that it is not to be so limited since changes can be made therein which are within the full intended scope of this invention defined in the appended claims.

I claim:

1. A waste heat recovery system for recovering heat from exhaust gases flowing through an exhaust stack from a source of heat, said system comprising:

(a) heat exchanger means having an inlet and an outlet, (b) first conduit means connected to the inlet of said exchanger means and to said exhaust stack, (c) second conduit means connected to the outlet of said exchanger means and to said exhaust stack, (d) means associated with at least one of said first and second conduit means for moving at least a portion of said exhaust gases from said exhaust stack through one of said conduit means and said exchanger means and returning said portion to the stack through the other of said conduit means, (e) means for supplying combustion air to said source of heat, and (f) means for actuating the means for moving said portion of exhaust gases to an "on" position in response to a preselected volume of air provided to the source of heat by said supply means.

2. A waste heat recovery system according to claim 1 wherein:

(a) said means for moving exhaust gases through the exchanger means is a second blower.

3. A waste heat recovery system according to claim 1, wherein:

(a) said first blower has an outlet to said source of heat and a damper positioned in said outlet, (b) a sensor is located in said source of heat to provide a sensing signal for controlling movement of said blower damper.

4. A waste heat recovery system according to claim 1, wherein:

(a) said first conduit means is connected to said exhaust stack at a position more adjacent to the source of heat than the connection of said second conduit means to said exhaust stack.

5. A method for recovering waste heat from exhaust gases flowing through an exhaust stack from a source of heat, said method comprising the steps of:

(a) providing a bypass conduit means having an inlet and an outlet connected with said exhaust stack for flow of exhaust gases through said bypass means, (b) disposing a heat exchanger means in said bypass means, (c) moving substantially all of the exhaust gases from said source of heat through said bypass means; and then (d) concurrently drawing a portion of the exhaust gases discharged to said exhaust stack from said bypass means into said bypass means for a return flow therethrough.

6. A waste heat recovery system for recovering heat from exhaust gases flowing through an exhaust stack from a source of heat, said system comprising:

(a) heat exchanger means having an inlet and an outlet, (b) first conduit means connected to the inlet of said exchanger means and to said exhaust stack, (c) second conduit means connected to the outlet of said exchanger means and to said exhaust stack, (d) means associated with at least one of said first and second conduit means for moving at least a portion of said exhaust gases from said exhaust stack through one of said conduit means and said exchanger means and returning said portion to the stack through the other of said conduit means, (e) means for supplying combustion air to said source of heat, and (f) means for actuating the means for moving said portion of exhaust gases to an "on" position in response to a preselected combustion condition of said source of heat.

* * * * *